US010315869B2

(12) United States Patent
Kikuchi et al.

(10) Patent No.: US 10,315,869 B2
(45) Date of Patent: Jun. 11, 2019

(54) SHEET FEEDING DEVICE AND IMAGE FORMING APPARATUS

(71) Applicant: FUJI XEROX CO., LTD., Tokyo (JP)

(72) Inventors: Hiroshi Kikuchi, Yokohama (JP); Kei Watanabe, Yokohama (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/922,400

(22) Filed: Mar. 15, 2018

(65) Prior Publication Data

US 2019/0092588 A1 Mar. 28, 2019

(30) Foreign Application Priority Data

Sep. 26, 2017 (JP) ..... 2017-185370

(51) Int. Cl.
*B65H 3/06* (2006.01)
*B65H 3/34* (2006.01)
*B65H 3/56* (2006.01)

(52) U.S. Cl.
CPC ..... *B65H 3/0684* (2013.01); *B65H 3/0607* (2013.01); *B65H 3/0669* (2013.01); *B65H 3/34* (2013.01); *B65H 3/56* (2013.01); *B65H 2301/363* (2013.01); *B65H 2402/64* (2013.01); *B65H 2403/40* (2013.01); *B65H 2404/725* (2013.01)

(58) Field of Classification Search
CPC .... B65H 3/063; B65H 3/0653; B65H 3/0607; B65H 3/0615; B65H 3/0661; B65H 3/0669; B65H 3/0684; B65H 3/34; B65H 3/54; B65H 3/56; B65H 3/565; B65H 3/66; B65H 9/06; B65H 9/08; B65H 9/10; B65H 9/101; B65H 9/106; B65H 2301/362; B65H 2301/3621; B65H 2301/363; B65H 2404/722; B65H 2404/725
See application file for complete search history.

(56) References Cited

U.S. PATENT DOCUMENTS 6,598,873 B2 * 7/2003 Takisawa ..... B65H 3/0669 271/246
7,571,905 B2 * 8/2009 Kim ..... B65H 3/0684 271/109
8,118,299 B2 * 2/2012 Sato ..... B65H 3/0684 271/117

(Continued)

FOREIGN PATENT DOCUMENTS

JP 2013-193830 A 9/2013

*Primary Examiner* — Ernesto A Suarez
(74) *Attorney, Agent, or Firm* — Sughrue Mion, PLLC

(57) ABSTRACT

A sheet feeding device includes: a feeding unit that is provided to be movable in a forward-backward direction to move forward or backward relative to a sheet placing unit on which a sheet is placed, and feeds the sheet; a moving unit that moves the feeding unit in the forward-backward direction; a contact unit that is provided to be movable, with which the sheet placed on the sheet placing unit is brought into contact; a limitation unit that limits movement of the contact unit; and a releasing unit that, when the moving unit moves the feeding unit in a direction away from the sheet placing unit, with the movement of the feeding unit, releases limitation on the movement of the contact unit by the limitation unit.

12 Claims, 12 Drawing Sheets

(56) References Cited

U.S. PATENT DOCUMENTS

| | | | | |
|---|---|---|---|---|
| 8,313,097 | B2 * | 11/2012 | Kayama | B65H 3/0684 271/117 |
| 8,382,095 | B2 * | 2/2013 | Osanai | B65H 1/04 271/117 |
| 8,678,375 | B2 * | 3/2014 | Hanamoto | B65H 5/00 271/117 |
| 9,315,347 | B2 * | 4/2016 | Hamada | B65H 7/06 |
| 9,771,230 | B2 * | 9/2017 | Uehara | B65H 3/0669 |
| 9,963,310 | B2 * | 5/2018 | Hanamoto | B65H 3/0607 |
| 10,160,611 | B2 * | 12/2018 | Tateishi | B65H 3/0684 |
| 2013/0241139 | A1 | 9/2013 | Hayakawa | |

* cited by examiner

SHEET FEEDING DEVICE AND IMAGE FORMING APPARATUS

CROSS REFERENCE TO RELATED APPLICATIONS

This application is based on and claims priority under 35 USC § 119 from Japanese Patent Application No. 2017-185370 filed Sep. 26, 2017.

BACKGROUND

Technical Field

The present invention relates to a sheet feeding device and an image forming apparatus.

Related Art

In a sheet feeding device of an image forming apparatus, in some cases, a contact section that contacts sheets stacked on a sheet stacking section and a releasing section that releases the contact by the contact section are provided in addition to a feeding section for feeding the sheets.

SUMMARY

According to an aspect of the present invention, there is provided a sheet feeding device including: a feeding unit that is provided to be movable in a forward-backward direction to move forward or backward relative to a sheet placing unit on which a sheet is placed, and feeds the sheet; a moving unit that moves the feeding unit in the forward-backward direction; a contact unit that is provided to be movable, with which the sheet placed on the sheet placing unit is brought into contact; a limitation unit that limits movement of the contact unit; and a releasing unit that, when the moving unit moves the feeding unit in a direction away from the sheet placing unit, with the movement of the feeding unit, releases limitation on the movement of the contact unit by the limitation unit.

BRIEF DESCRIPTION OF THE DRAWINGS

An exemplary embodiment of the present invention will be described in detail based on the following figures, wherein.

DETAILED DESCRIPTION

Hereinafter, an exemplary embodiment according to the present invention will be described in detail with reference to attached drawings.

[Image Forming Apparatus 1]

Figure 1:
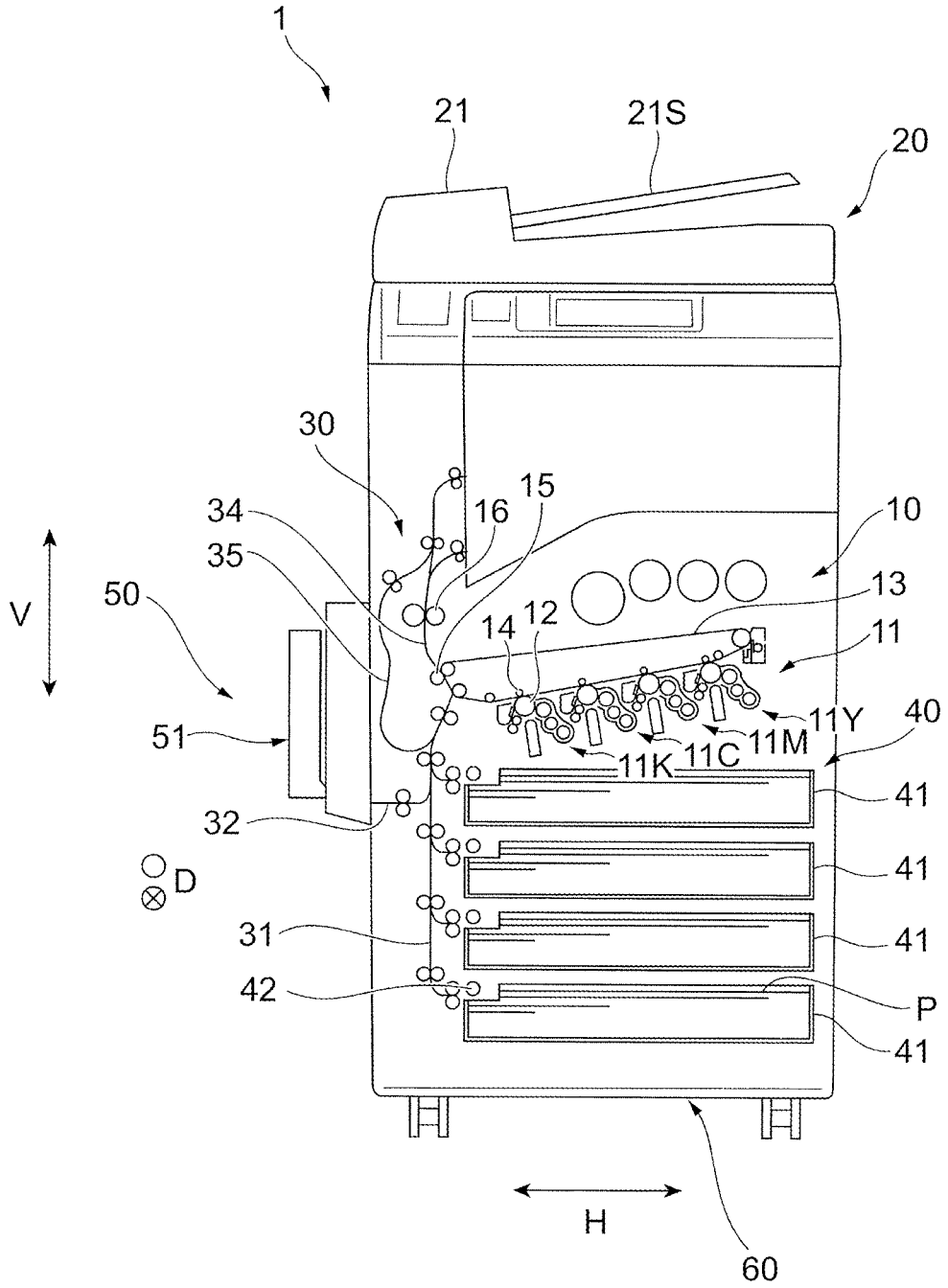
FIG. 1 is an overall view of an image forming apparatus of the exemplary embodiment.

FIG. 1 is an overall view of an image forming apparatus 1 of the exemplary embodiment.

The image forming apparatus 1 includes: an image forming section 10 that forms an image corresponding to image data of each color; an image reading device 20 that reads an image of an original; a sheet transport system 30 that transports sheets P; and a first sheet supply section 40 that supplies the sheets P to the image forming section 10. Moreover, the image forming apparatus 1 includes: a second sheet supply section 50 (an example of a sheet feeding device) that supplies the sheets P to the image forming section 10; and a main body housing section 60 that contains the image forming section 10, the sheet transport system 30 and the first sheet supply section 40.

Note that, in the following description, a direction of a front side and a back side on the page of the image forming apparatus 1 shown in FIG. 1 is referred to as a front-back direction D. Moreover, a description will be given while assuming that a horizontal direction on the page of the image forming apparatus 1 shown in FIG. 1 is a horizontal direction H and a vertical direction on the page is a vertical direction V.

The image forming section 10 is provided with four image forming units 11 (11Y, 11M, 11C and 11K) disposed in parallel at regular intervals. Each of the image forming units 11Y, 11M, 11C and 11K includes a photoconductive drum 12 that forms an electrostatic latent image and carries a toner image, to thereby forms the toner image by the so-called electrophotographic system. The image forming units 11Y, 11M, 11C and 11K form toner images of yellow (Y), magenta (M), cyan (C) and black (K), respectively.

Moreover, the image forming section 10 includes an intermediate transfer belt 13 onto which the toner image of each color formed on the photoconductive drum 12 of each image forming unit 11 is transferred. Moreover, the image forming section 10 includes a primary transfer roll 14 that sequentially transfers (primarily transfers) toner images of respective colors formed in the image forming units 11 onto the intermediate transfer belt 13. Further, the image forming section 10 includes: a secondary transfer section 15 that collectively transfers (secondarily transfers) the toner images of the respective colors overlapped to be formed on the intermediate transfer belt 13 onto the sheet P; and a fixing section 16 that fixes the toner images of the respective colors having been secondarily transferred to the sheet P.

The image reading device 20 transmits read image data to a controller of the image forming section 10 or a device outside of the image forming apparatus. Moreover, the image reading device 20 includes an original feeding device 21 that sequentially feeds originals stacked on a stacking section 21S one by one to a reading sensor for causing the sensor to read images on the originals.

The sheet transport system 30 includes: a first transport path 31 that transports the sheets P supplied from the first sheet supply section 40 toward the secondary transfer section 15; a second transport path 32 that transports the sheets P supplied from the second sheet supply section 50 toward the secondary transfer section 15; a third transport path 34 that transports the sheets P from the secondary transfer section 15 to the fixing section 16; and a fourth transport path 35 that inverts the sheets P passed through the fixing section 16 and transports the sheets P to the secondary transfer section 15 again.

The first sheet supply section 40 includes plural sheet container sections 41. Moreover, each of the sheet container section 41 has a feed-out roll 42 that feeds out the sheets P that are contained. Then, the first sheet supply section 40 feeds out the sheets P from each of the sheet container section 41 and supplies the sheets P toward the sheet transport system 30.

<Second Sheet Supply Section 50>

Figure 2:
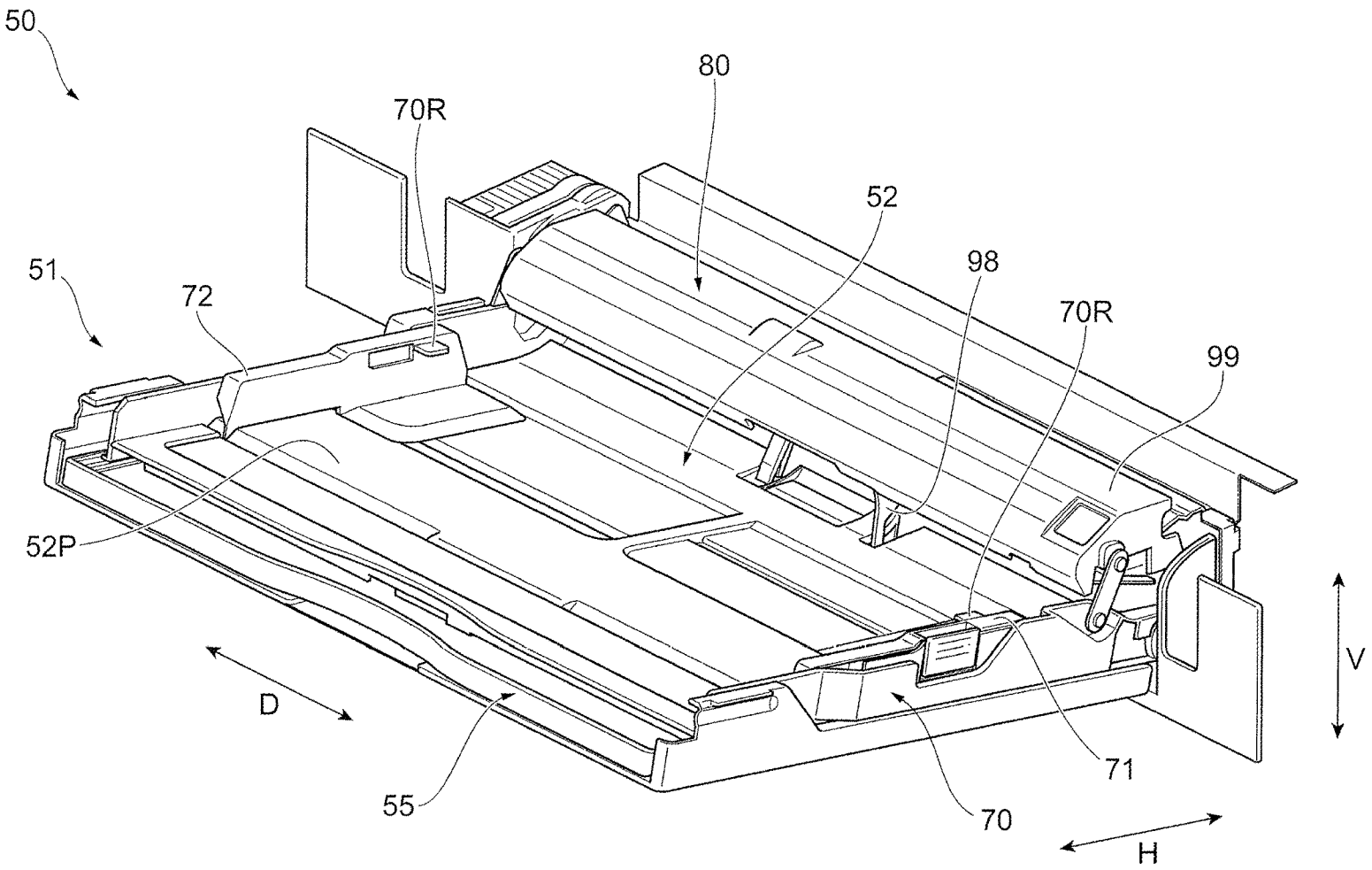
FIG. 2 is an overall perspective view of a second sheet supply section of the exemplary embodiment.

FIG. 2 is an overall perspective view of a second sheet supply section 50 of the exemplary embodiment.

As shown in FIG. 2, the second sheet supply section 50 includes: a sheet section 51 on which the sheets P are placed; and a sheet feeding section 80 that feeds the sheets P placed on the sheet section 51 toward the image forming section 10.

The second sheet supply section 50 is a so-called manual feed tray. The second sheet supply section 50 is, when a user is going to form an image on a sheet P of an arbitrary size, a component on which the sheets P of the arbitrary size are set to be supplied to the image forming section 10. The second sheet supply section 50 of the exemplary embodiment is able to supply sheets sizes of which ranges from, for example, a relatively small-sized sheet, such as a postcard, to a nonstandard-sized sheet up to A3 size, for example, toward the image forming section 10.

Moreover, as shown in FIG. 2, the sheet feeding section 80 includes: a sensor 98 that senses presence or absence of the sheets P on a sheet stacking surface 52P; and a cover 99 that covers various kinds of components in the sheet feeding section 80.

The sensor 98 is disposed on a downstream side in the sheet feeding direction (in the exemplary embodiment, the horizontal direction H) in the sheet section 51. Moreover, the sensor 98 is rotatably supported, and, when the sheets P are placed on the sheet stacking surface 52P, the end portion of the sheets P on the downstream side in the feeding direction thereof can be brought into contact with the sensor 98. Then, the sensor 98 is able to sense the presence or absence of the sheets on the sheet stacking surface 52P in response to a rotating angle of itself.

The cover 99 is fastened to the main body housing section 60 (refer to FIG. 1). The cover 99 covers components subjected to moving operations, such as roll members.

[Sheet Section 51]

The sheet section 51 includes: a sheet stacking section 52 on which the sheets P are placed (an example of a sheet placing unit); an expansion section 55 that expands the surface to place the sheets P in addition to the sheet stacking section 52; and a sheet guiding section 70 that guides the sheets P toward the sheet feeding section 80.

Note that the sheet section 51 of the exemplary embodiment is provided rotatably so that the sheet stacking surface 52P, which will be described later, can be positioned in an open state of facing upward in the vertical direction V or in a closed sate of facing the side portion of the main body housing section 60 (refer to FIG. 1).

[Sheet Stacking Section 52]

The sheet stacking section 52 includes the sheet stacking surface 52P facing upward in the vertical direction V. Then, the sheet stacking section 52 forms a location, where a sheet bundle (sheets P) to be fed by the sheet feeding section 80 is placed, on the sheet stacking surface 52P. Moreover, in the exemplary embodiment, the sheet feeding direction in which the sheets P are fed in the sheet stacking section 52 is the horizontal direction H.

Note that, in the sheet stacking section 52 of the exemplary embodiment, the width in the front-back direction D corresponds to the length of the A4-size sheet. Moreover, in the sheet stacking section 52, the width in the horizontal direction H corresponds to the width of the A4-size sheet.

[Expansion Section 55]

The expansion section 55 is disposed below the sheet stacking section 52 in the vertical direction V. Moreover, the expansion section 55 is movable in the horizontal direction H. Then, the expansion section 55 expands the surface for placing the sheets P in addition to the sheet stacking surface 52P in a state of being pulled out from the sheet stacking section 52. Then, in the state of being pulled out, the expansion section 55 makes it possible to place, for example, up to the A3-size sheet together with the sheet stacking section 52. On the other hand, when not being used by the user, the expansion section 55 is contained under the sheet stacking section 52.

[Sheet Guiding Section 70]

The sheet guiding section 70 includes: a first guiding section 71 that is provided on the front side in the front-back direction D and guides the sheets placed on the sheet stacking section 52; and a second guiding section 72 that is provided on the back side to be paired with the first guiding section 71 for guiding the sheets P.

The first guiding section 71 and the second guiding section 72 are movable in the front-back direction D in the sheet stacking section 52 by the operation of the user. The first guiding section 71 and the second guiding section 72 can be positioned at an arbitrary position in the front-back direction D.

Further, the first guiding section 71 and the second guiding section 72 move so that the moving amount when one of them is moved and the moving amount when the other one is moved are the same. Consequently, the sheet guiding section 70 is aligned so that the center portion of the sheet in the front-back direction D is aligned to a predetermined position in the sheet stacking section 52.

Further, each of the first guiding section 71 and the second guiding section 72 includes a regulation section 70R provided in accordance with the maximum sheet number stackable on the sheet stacking surface 52P. The regulation section 70R projects toward the inside of the sheet stacking surface 52P. Moreover, when the sheets P of the maximum stacking number are stacked on the sheet stacking surface 52P, the regulation section 70R is provided at the height of the uppermost sheet P on the bundle of sheets of the maximum stacking number. The regulation section 70R indicates the height (thickness) of the sheet bundle corresponding to the maximum stacking number to the user, and regulates the sheets not to be stacked exceeding the regulation section 70R.

[Sheet Feeding Section 80]

Figure 3:
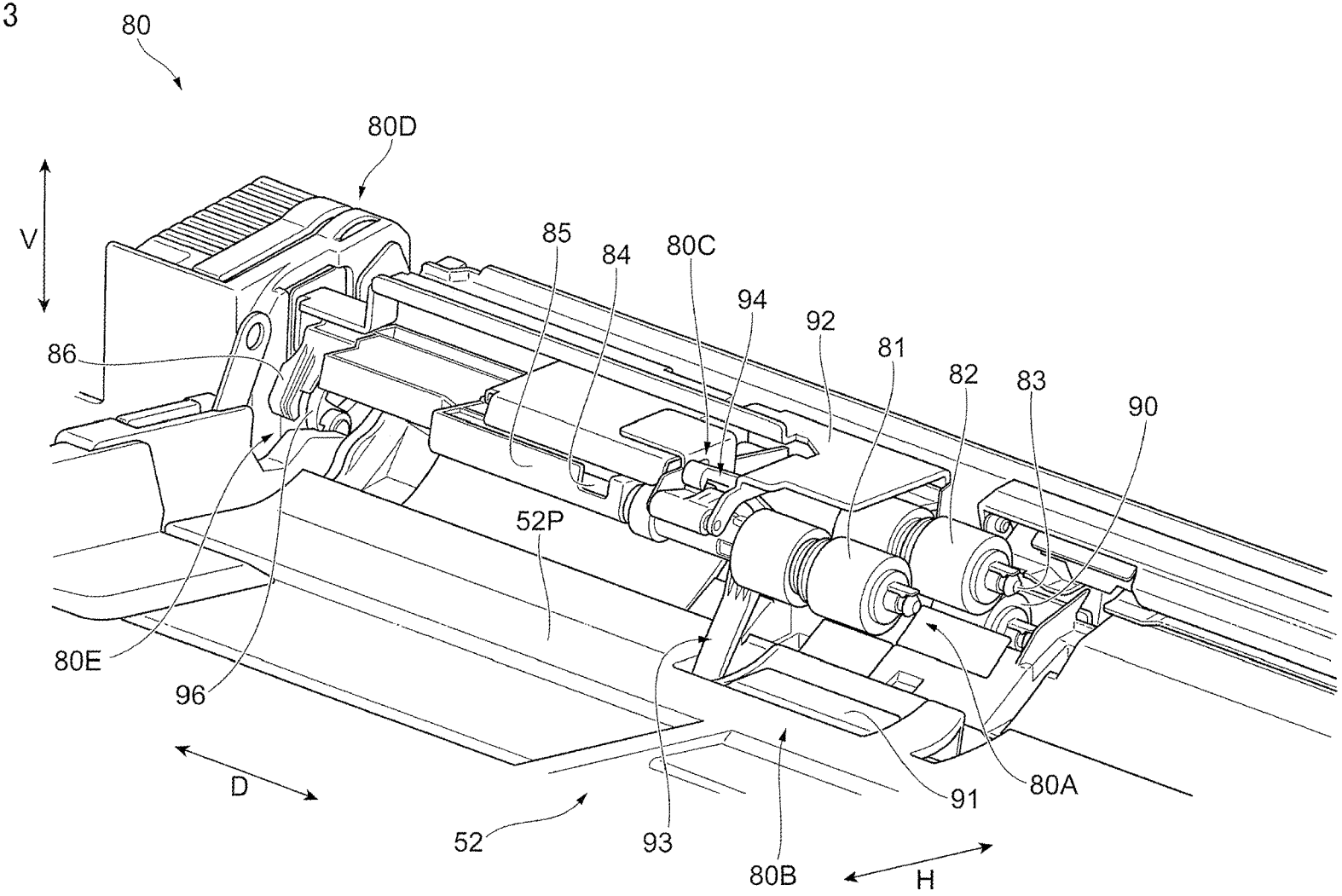
FIG. 3 is an overall perspective view of a sheet feeding section of the exemplary embodiment.

FIG. 3 is an overall perspective view of the sheet feeding section 80 of the exemplary embodiment.

Figure 4:
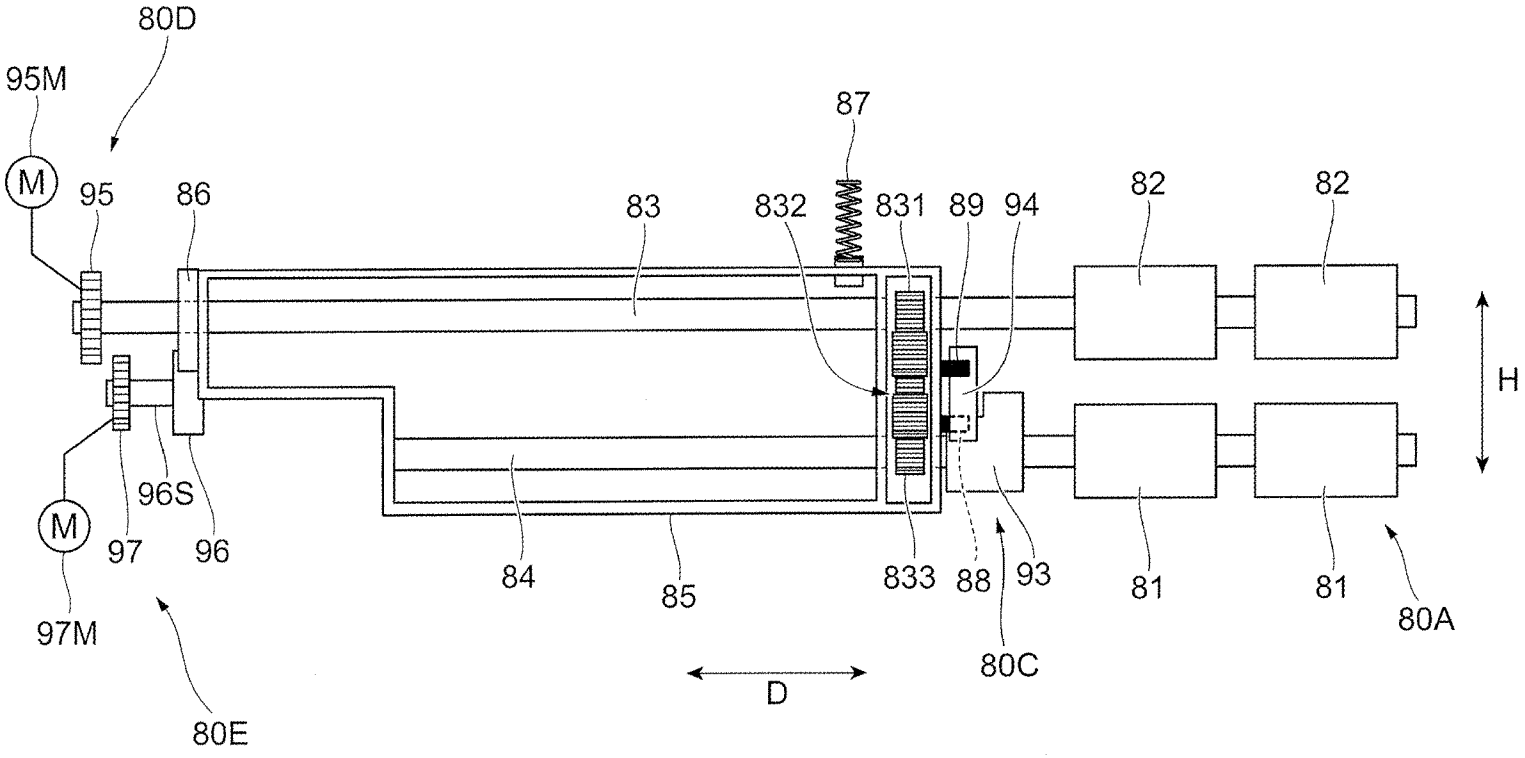
FIG. 4 is a plan view of the sheet feeding section of the exemplary embodiment.

FIG. 4 is a plan view of the sheet feeding section 80 of the exemplary embodiment.

Figure 5:
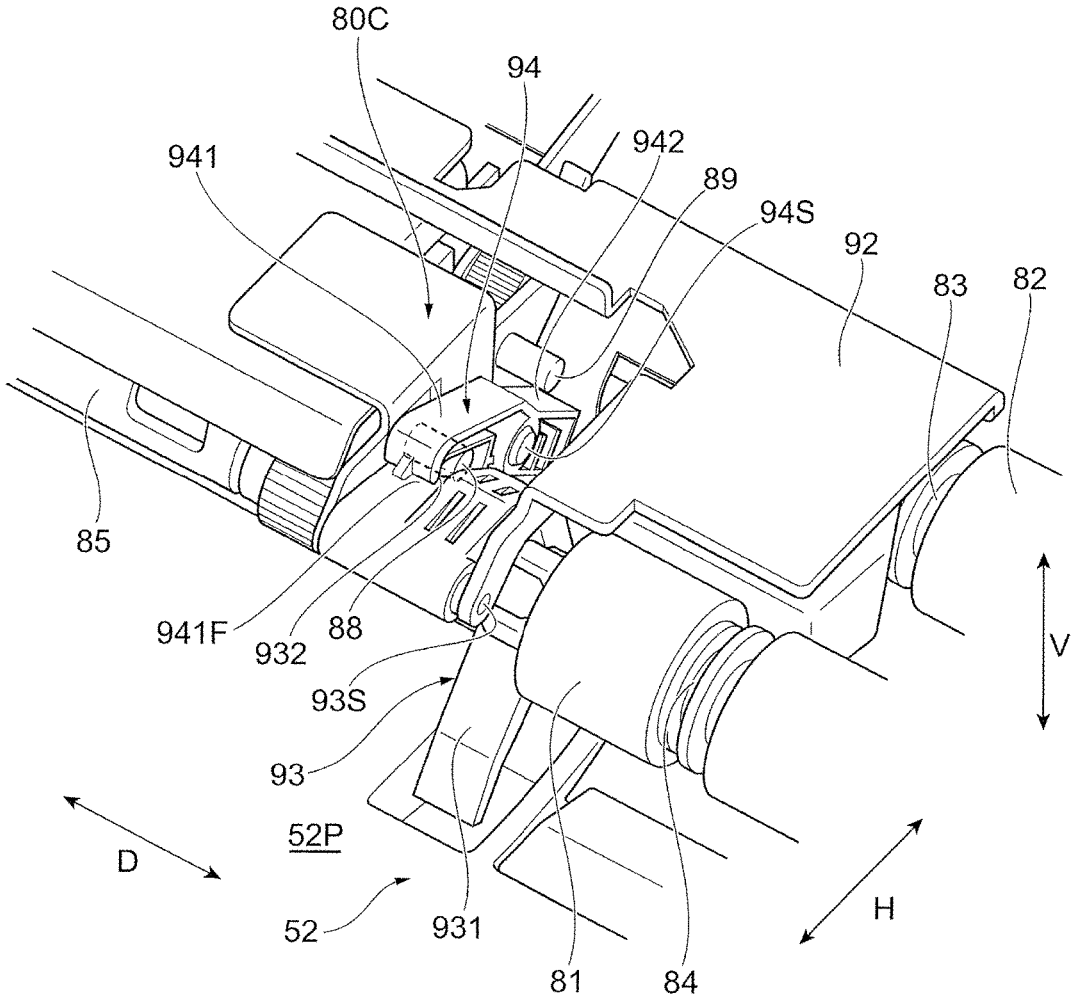
FIG. 5 is an illustration diagram of a regulation section of the exemplary embodiment.

FIG. 5 is an illustration diagram of a regulation section 80C of the exemplary embodiment. Note that FIG. 5 shows a state in which a supporter 85 is positioned at a standby position, which will be described later.

Figure 6:
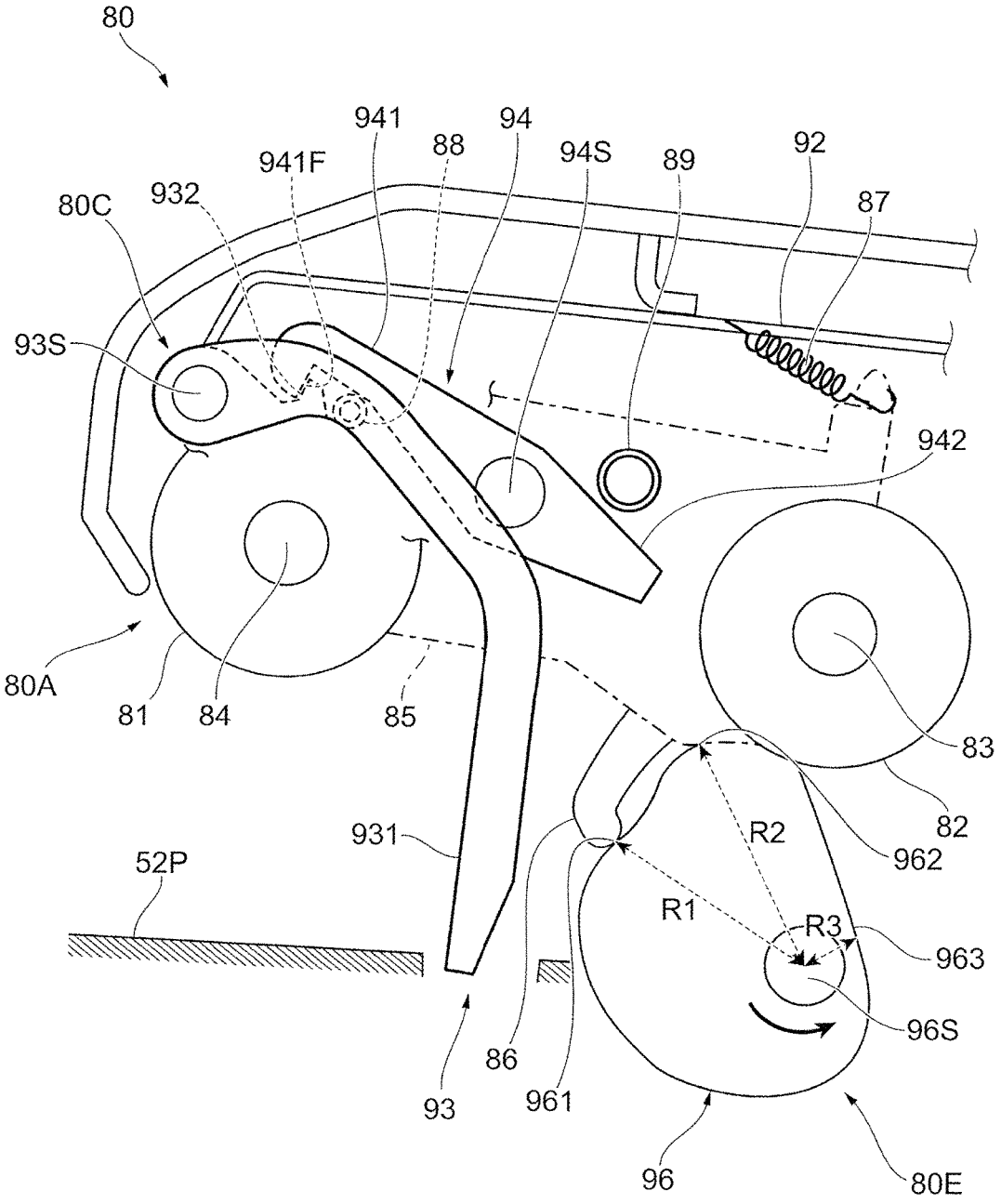
FIG. 6 is an illustration diagram that illustrates a relationship among a feeding section, the regulation section and a second drive section of the exemplary embodiment.

FIG. 6 is an illustration diagram that illustrates a relationship among a feeding section 80A, the regulation section 80C and a second drive section 80E of the exemplary embodiment.

As shown in FIG. 3, the sheet feeding section 80 includes: a feeding section 80A (an example of a feeding unit) provided to be movable with respect to the sheet stacking surface 52P to feed the sheets; and a suppressing section 80B that suppresses multiple feeding of the sheets P when the sheets P are fed by the feeding section 80A. Moreover, the sheet feeding section 80 includes a regulation section 80C that regulates movement of the sheets P (the sheet bundle) stacked on the sheet stacking surface 52P toward the downstream side in the sheet feeding direction. Further, the sheet feeding section 80 includes: a first drive section 80D that drives pickup rolls 81 and feed rolls 82, which will be described later; and a second drive section 80E (an example of a moving unit) that drives a supporter 85, which will be described later.

(Feeding Section 80A)

As shown in FIG. 4, the feeding section 80A includes: the pickup rolls 81 that are provided to be movable with respect to the sheet stacking surface 52P (refer to FIG. 3) to pick up the sheets P on the sheet stacking surface 52P; and the feed rolls 82 that move in the same manner as the pickup rolls 81 to feed the sheets P picked up by the pickup rolls 81 toward the downstream side in the feeding direction. Further, the feeding section 80A includes: a first shaft 83 to which the feed rolls 82 are attached; and a second shaft 84 to which the pickup rolls 81 are attached.

Further, the feeding section 80A includes a first gear 831, a gear group 832 and a second gear 833 that transfer rotation of the first shaft 83 to the second shaft 84. Moreover, the feeding section 80A includes: the supporter 85 through which the above-described first shaft 83 and second shaft 84 are passed; an arm 86 fastened to the supporter 85; and a tension spring 87 that provides a spring force (an example of an elastic force) to the supporter 85.

Then, the feeding section 80A includes: an unlock section 88 (an example of a releasing unit) that releases lock (limit on movement) on a stopper 93 by a stopper lock 94 to be described later; and a maintaining section 89 (an example of a maintaining unit) that maintains an unlocked state of the stopper 93 by the stopper lock 94.

The pickup rolls 81 are fastened to the second shaft 84. Moreover, in the exemplary embodiment, two pickup rolls 81 are provided in line in an axial direction of the second shaft 84. Then, with the rotation of the second shaft 84, the pickup rolls 81 are rotated in the same direction as the second shaft 84.

The feed rolls 82 are fastened to the first shaft 83. Moreover, in the exemplary embodiment, two feed rolls 82 are provided in line in the axial direction of the first shaft 83. Then, with the rotation of the first shaft 83, the feed rolls 82 are rotated in the same direction as the first shaft 83.

Moreover, the feed rolls 82 are provided downstream of the pickup rolls 81 in the sheet feeding direction. The feed rolls 82 feed the sheet P while holding the sheet P with a retard roll 90 (refer to FIG. 3), which will be described later.

The first shaft 83 is rotatably supported by the supporter 85 via a not-shown bearing. Moreover, the first shaft 83 is provided along the front-back direction D. Then, the first shaft 83 rotates, to thereby rotate the feed rolls 82 as described above. On the other hand, the first shaft 83 does not transfer the rotational force to the supporter 85. In other words, the first shaft 83 slips in the supporter 85. On the other hand, the first shaft 83 functions as a rotation shaft of the supporter 85.

The second shaft 84 is rotatably supported by the supporter 85 via a not-shown bearing. The second shaft 84 is disposed upstream of the first shaft 83 in the sheet feeding direction. Moreover, the second shaft 84 is provided along the first shaft 83 with a predetermined interval. Then, the second shaft 84 rotates, to thereby rotate the pickup rolls 81 as described above. However, the second shaft 84 does not transfer the rotational force to the supporter 85.

The first gear 831 is fastened to the first shaft 83. Moreover, the first gear 831 is connected to the gear group 832. The first gear 831 transfers the rotational force of the first shaft 83 to the gear group 832.

The gear group 832 includes plural gear members. Then, the gear group 832 is connected to each of the first gear 831 and the second gear 833. The gear group 832 transfers the rotational force of the first gear 831 to the second gear 833. Moreover, the number of gears included in the gear group 832 is adjusted so that the rotation direction of the first gear 831 and the rotation direction of the second gear 833 are the same direction. In other words, the gear group 832 causes the first shaft 83 and the second shaft 84 to rotate in the same rotation direction.

The second gear 833 is fastened to the second shaft 84. Moreover, the second gear 833 is connected to the gear group 832. The second gear 833 transfers the rotational force of the gear group 832 to the second shaft 84.

An outline of the supporter 85 is formed into a rectangular shape extending long in the front-back direction D. Then, in the exemplary embodiment, the supporter 85 is provided, inside thereof, with the first shaft 83, the second shaft 84, the first gear 831, the gear group 832 and the second gear 833.

Moreover, the supporter 85 is rotatable around the first shaft 83 as the rotation center. In the exemplary embodiment, the supporter 85 rotates, to thereby move the pickup rolls 81 forward or backward with respect to the sheet stacking surface 52P (refer to FIG. 3).

Then, as shown in FIG. 3, before the sheets are fed, the supporter 85 of the exemplary embodiment sometimes causes the pickup rolls 81 to be positioned at a standby position (sheet setting position), which is away from the sheet stacking surface 52P by a predetermined distance for accepting setting of the sheets P on the sheet stacking surface 52P by the user.

Moreover, immediately before the sheet feeding, the supporter 85 of the exemplary embodiment sometimes causes the pickup rolls 81 to be positioned at a releasing position (an unlock position) for releasing limitation on movement of the stopper 93, which will be described later, of the regulation section 80C.

Further, when the sheet feeding is to be performed, the supporter 85 of the exemplary embodiment sometimes causes the pickup rolls 81 to be positioned at the feeding position (sheet pickup position) where the pickup rolls 81 are brought into contact with the sheets P placed on the sheet stacking surface 52P.

As shown in FIG. 4, the arm 86 is fastened to an end portion of the supporter 85 in the longitudinal direction. In the exemplary embodiment, the arm 86 is disposed on an opposite side of the side where the feed rolls 82 are provided. The arm 86 is formed to extend long in the horizontal direction H. Then, the arm 86 contacts a rotating cam 96, which will be described later, of the second drive section 80E. The arm 86 moves with the rotation of the rotating cam 96, to thereby move the supporter 85.

One end of the tension spring 87 is connected to the supporter 85, and the other end thereof is connected to a stay 92, which will be described later. Moreover, the tension spring 87 is connected to the supporter 85 on the downstream side of the first shaft 83 in the sheet feeding direction. Consequently, the tension spring 87 provides a force to the supporter 85 rotating around the first shaft 83 as the rotation center, the force rotating the second shaft 84 downward in the vertical direction V. In other words, the tension spring 87 always provides a force of a direction in which the pickup rolls 81 move toward the sheet stacking section 52 (refer to FIG. 3) to the supporter 85.

As shown in FIG. 5, the unlock section 88 is fastened to the supporter 85. The unlock section 88 is provided to an end portion of the supporter 85 in the longitudinal direction, which is on the stopper lock 94 side, which will be described later, of the regulation section 80C. The unlock section 88 of the exemplary embodiment projects in a columnar shape from the supporter 85 along the front-back direction D. Then, the unlock section 88 is disposed to contact the stopper lock 94 in accordance with the moving position of the supporter 85. In the exemplary embodiment, the unlock section 88 is able to contact the stopper lock 94 when the supporter 85 is at the releasing position.

The maintaining section 89 is fastened to the supporter 85. The maintaining section 89 is provided to an end portion of the supporter 85 in the longitudinal direction, which is on the stopper lock 94 side, which will be described later, of the regulation section 80C. The maintaining section 89 of the exemplary embodiment projects in a columnar shape from the supporter 85 along the front-back direction D. Then, the maintaining section 89 is disposed to contact the stopper lock 94 in accordance with the moving position of the supporter 85. In the exemplary embodiment, as will be described later, the maintaining section 89 is able to contact the stopper lock 94 when the supporter 85 is at the feeding position.

(Suppressing Section 80B)

As shown in FIG. 3, the suppressing section 80B includes: the retard roll 90 that rotates in a direction opposite to the rotation direction of the feed rolls 82; and a suppressing member 91 provided at a position facing the pickup rolls 81.

The retard roll 90 is provided at a position facing the feed rolls 82. The retard roll 90 rotates to forward the sheets P in a direction opposite to the sheet feeding direction by the feed rolls 82. In other words, the retard roll 90 rotates in the direction opposite to the direction of rotation of the feed rolls 82. Then, the retard roll 90 pinches the sheets P with the feed rolls 82. For example, when the two sheets P are overlapped and sent between the retard roll 90 and the feed rolls 82 from the pickup rolls 81, the retard roll 90 feeds back the sheet P that is not in contact with the feed rolls 82 to an opposite side of the sheet feeding direction. Consequently, only one sheet P is supplied by the feed rolls 82.

The suppressing member 91 is provided at a position facing the pickup rolls 81. The suppressing member 91 contacts, of the sheet bundle stacked on the sheet stacking surface 52P, the sheet P that is closest to the sheet stacking surface 52P. Then, when the uppermost sheet P of the sheet bundle is fed by the pickup rolls 81, the suppressing member 91 causes the other sheets P to stay on the sheet stacking surface 52P.

(Regulation Section 80C)

Subsequently, the regulation section 80C will be described in detail.

As shown in FIG. 3, when the sheets P are set on the sheet stacking section 52, it is necessary to stem the sheets P on the downstream side in the sheet feeding direction of the sheet stacking section 52 to prevent the sheets P from entering the back side of the sheet feeding section 80. Then, in the sheet feeding section 80 of the exemplary embodiment, movement of the sheets P toward the downstream side of the sheet feeding direction is regulated by the regulation section 80C. On the other hand, when the sheets P placed on the sheet stacking section 52 are fed, it is necessary to release regulation on the movement of the sheets P by the regulation section 80C.

As shown in FIG. 5, the regulation section 80C includes: the stay 92 fastened to the main body housing section 60 (refer to FIG. 1); the stopper 93 (an example of a contact unit) that contacts the sheets P stacked on the sheet stacking section 52 to regulate movement of the sheets P toward the downstream side in the feeding direction; and the stopper lock 94 (an example of a limitation unit) that limits movement of the stopper 93.

The stay 92 is formed by a sheet metal. Then, the stay 92 is supported by the main body housing section 60. Note that, even when the supporter 85 is moved by the second drive section 80E, the stay 92 does not move.

As shown in FIG. 6, the stopper 93 is a member including a bending portion and extending in one direction. The stopper 93 is provided to be rotatable around a stopper shaft 93S as a rotation center. In the exemplary embodiment, the stopper shaft 93S is supported by the stay 92. In other words, the stopper 93 is provided separately from the supporter 85.

Moreover, the stopper 93 includes: a sheet regulation portion 931 with which the sheets P are brought into contact; and a receiving portion 932 that receives engagement of the stopper lock 94.

Note that, in the exemplary embodiment, a center of gravity of the stopper 93 exists on the downstream side of the stopper shaft 93S in the sheet feeding direction. Consequently, in a free state of not being in contact with the sheets P, the sheet regulation portion 931 side of the stopper 93 is going to rotate toward the downstream side in the sheet feeding direction by its own weight.

The sheet regulation portion 931 is formed to extend from the stopper shaft 93S toward the sheet stacking surface 52P. Then, in a state in which rotation of the stopper 93 is prevented by the stopper lock 94, the sheet regulation portion 931 regulates movement of the sheets P stacked on the sheet stacking surface 52P toward the downstream side of the stopper 93 in the sheet feeding direction.

The receiving portion 932 is formed to receive a latch portion 941F, which will be described later, of the stopper lock 94. Then, in the state where the stopper lock 94 is engaged, the receiving portion 932 limits the rotation of the stopper 93 around the stopper shaft 93S. Even when the sheet regulation portion 931 of the stopper 93 is pressed by the sheet bundle, the receiving portion 932 stops the rotation of the stopper 93. This makes the stopper 93 regulate the movement of the sheets P by the sheet regulation portion 931. On the other hand, in the state where the stopper lock 94 is not engaged in the receiving portion 932, the stopper 93 is able to rotate around the stopper shaft 93S. Consequently, when the sheets P on the sheet stacking surface 52P are fed, the stopper 93 is rotated by the contact of the sheets P, to thereby makes it possible to feed the sheets P.

The stopper lock 94 is a member extending long in one direction. Then, the stopper lock 94 is provided to be rotatable around a stopper lock shaft 94S as a rotation center. In the exemplary embodiment, the stopper lock shaft 94S is supported by the stay 92. In other words, the stopper lock 94 is provided separately from the supporter 85.

Moreover, the stopper lock 94 includes: a first arm portion 941 provided on one side with respect to the stopper lock shaft 94S and a second arm portion 942 provided on the other side with respect to the stopper lock shaft 94S.

The first arm portion 941 includes, on an end portion thereof, the latch portion 941F (an example of a latch unit) to be engaged in the receiving portion 932 of the stopper 93. Then, the latch portion 941F is engaged in the receiving portion 932 of the stopper 93, and thereby, the stopper lock 94 limits the rotation of the stopper 93.

Then, the first arm portion 941 is positioned on the course of the unlock section 88 that moves with the supporter 85. In particular, the first arm portion 941 is positioned on the course of the unlock section 88 when the supporter 85 is at the releasing position, to thereby contact the unlock section 88 at that time. Then, due to the contact of the unlock section 88 with the first arm portion 941 of the stopper lock 94, the stopper lock 94 rotates in a direction in which the latch portion 941F moves away from the receiving portion 932 of the stopper 93.

The second arm portion 942 is positioned on the course of the maintaining section 89 that moves with the supporter 85. In particular, the second arm portion 942 is positioned on the course of the maintaining section 89 when the supporter 85 is at the feeding position, to thereby contact the maintaining section 89 at that time. Then, due to the contact of the maintaining section 89 with the second arm portion 942 of the stopper lock 94, the stopper lock 94 rotates in a direction in which the latch portion 941F moves away from the receiving portion 932 of the stopper 93, and the state is maintained.

Moreover, in the exemplary embodiment, the first arm portion 941 is longer than the second arm portion 942. Consequently, in a free state of not being in contact with other members, the first arm portion 941 side of the stopper lock 94 is going to rotate in the downward direction by its own weight.

(First Drive Section 80D)

As shown in FIG. 4, the first drive section 80D includes: a drive gear 95 fastened to the first shaft 83; and a first motor 95M that rotates the drive gear 95.

The drive gear 95 is connected to a not-shown gear member driven by the first motor 95M. The drive gear 95 transfers the power of the first motor 95M to the first shaft 83.

The first motor 95M is controlled by a not-shown controller to be operated at a predetermined timing. Then, the first motor 95M rotates the first shaft 83 via the drive gear 95, to thereby rotate the feed rolls 82. Further, the first motor 95M rotates the second shaft 84 via the first shaft 83, to thereby rotate the pickup rolls 81.

(Second Drive Section 80E)

The second drive section 80E includes: a rotating cam 96 (an example of a rotating cam) connected to the arm 86; a cam shaft 96S serving as the rotation shaft of the rotating cam 96; a second drive gear 97 fastened to the cam shaft 96S; and a second motor 97M that rotates the second drive gear 97.

As shown in FIG. 6, the rotating cam 96 has a predetermined cam profile formed on an outer circumferential portion thereof, and rotates around the cam shaft 96S as the rotation center. The rotating cam 96 moves the supporter 85 via the arm 86.

The rotating cam 96 of the exemplary embodiment includes, as the cam profile in the circumferential direction of the rotating cam 96: a first shape portion 961 that causes the supporter 85 to be positioned at the standby position; a second shape portion 962 that causes the supporter 85 to be positioned at the releasing position; and a third shape portion 963 that causes the supporter 85 to be positioned at the feeding position. Then, in the exemplary embodiment, the rotating cam 96 rotates in the predetermined direction, to be thereby brought into contact with the arm 86 by the first shape portion 961, the second shape portion 962 and the third shape portion 963 in this order.

The first shape portion 961 is a region where the distance from the cam shaft 96S is a first radius R1.

The second shape portion 962 is a region where the distance from the cam shaft 96S is a second radius R2, which is longer than the first radius R1. Note that the second radius R2 in the second shape portion 962 is the largest radius in the rotating cam 96 of the exemplary embodiment.

Further, the third shape portion 963 is a region where the distance from the cam shaft 96S is a third radius R3, which is shorter than the first radius R1. The third radius R3 in the third shape portion 963 is the shortest radius in the rotating cam 96 of the exemplary embodiment. Then, in the exemplary embodiment, with the third shape portion 963, the contact by the arm 86 is released, to thereby set the arm 86 free.

Then, the rotating cam 96 of the exemplary embodiment varies smoothly from the first shape portion 961 to the second shape portion 962 and then the third shape portion 963. Consequently, in the exemplary embodiment, when the portion of the rotating cam 96 that is in contact with the arm 86 is changed, a load due to the change is not applied to the second motor 97M.

The cam shaft 96S is rotatably supported by a not-shown member. To the cam shaft 96S, the rotating cam 96 is fastened. The cam shaft 96S becomes the rotation center of the rotating cam 96.

The second drive gear 97 is connected to a not-shown gear member driven by the second motor 97M. The second drive gear 97 transfers the power of the second motor 97M to the cam shaft 96S.

The second motor 97M is controlled by a not-shown controller to be operated at a predetermined timing and a rotation amount. Then, the second motor 97M rotates the cam shaft 96S via the second drive gear 97, to thereby rotate the rotating cam 96. Note that, in the exemplary embodiment, the second motor 97M rotates the rotating cam 96 in a predetermined direction.

Next, moving operations of the supporter 85 by the first drive section 80D will be described in detail.

FIGS. 7A to 7D are illustration diagrams of operations of the supporter 85 of the exemplary embodiment.

As described above, in the exemplary embodiment, the first drive section 80D rotates the supporter 85 in accordance with the rotating angle of the rotating cam 96. With the rotation, the supporter 85 moves the pickup rolls 81 forward or backward with respect to the sheet stacking surface 52P.

Figure 7A:
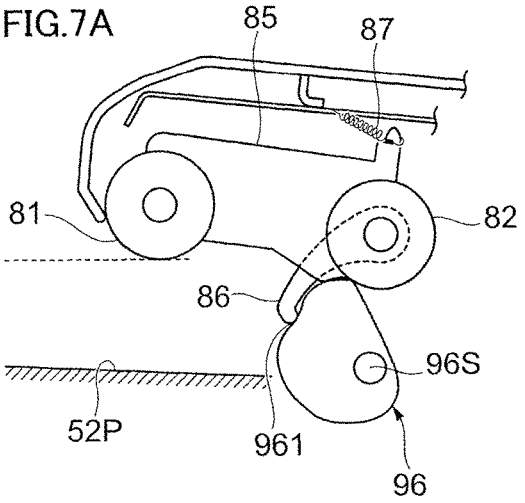
FIGS. 7A to 7D are illustration diagrams of operations of a supporter of the exemplary embodiment.

As shown in FIG. 7A, the rotating cam 96 brings the first shape portion 961 in contact with the arm 86, to thereby set the supporter 85 at the standby position. In this state, the pickup rolls 81 supported by the supporter 85 are separated from the sheet stacking surface 52P by a predetermined distance. The position of the pickup rolls 81 at this time corresponds to the height of the regulation section 70R (refer to FIG. 2). In other words, the rotating cam 96 brings the first shape portion 961 into contact with the arm 86, to thereby causes the pickup rolls 81 at the position corresponding to the height of the uppermost sheet when the sheets of the maximum stacking number are set on the sheet stacking surface 52P (full stack height).

Figure 7B:
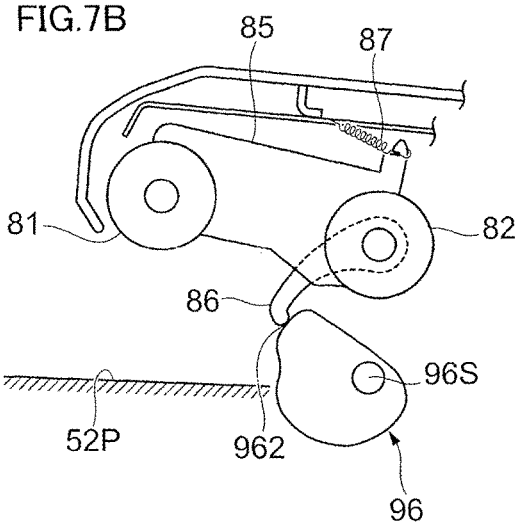

As shown in FIG. 7B, the rotating cam 96 brings the second shape portion 962 in contact with the arm 86, to thereby set the supporter 85 at the releasing position. In this state, the pickup rolls 81 supported by the supporter 85 are at the position higher than the height of the uppermost sheet P when the sheets P of the maximum stacking number are set on the sheet stacking surface 52P.

Figure 7C:
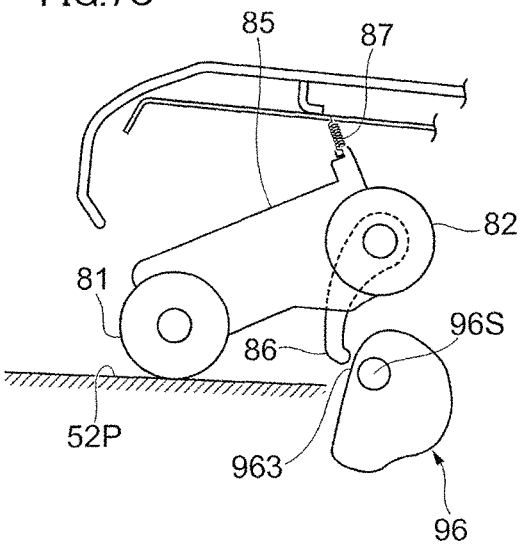

As shown in FIG. 7C, the rotating cam 96 causes the third shape portion 963 to face the arm 86, to thereby set the supporter 85 at the feeding position. Specifically, due to the third shape portion 963 of the rotating cam 96 facing the arm 86, the arm 86 becomes incapable of reaching the rotating cam 96. As a result, the arm 86 and the supporter 85 to which the arm 86 is connected become freely rotatable around the first shaft 83 as the rotation center. Here, to the supporter 85, the tension spring 87 is connected. Consequently, a side of the supporter 85 opposite to the pickup rolls 81 in the horizontal direction H is pulled up by the tension spring 87. As a result, the pickup rolls 81 supported by the supporter 85 are moved in a direction approaching the sheet stacking surface 52P. Note that, in this state, the pickup rolls 81 are positioned at the height of the sheets P placed on the sheet stacking surface 52P.

Figure 7D:
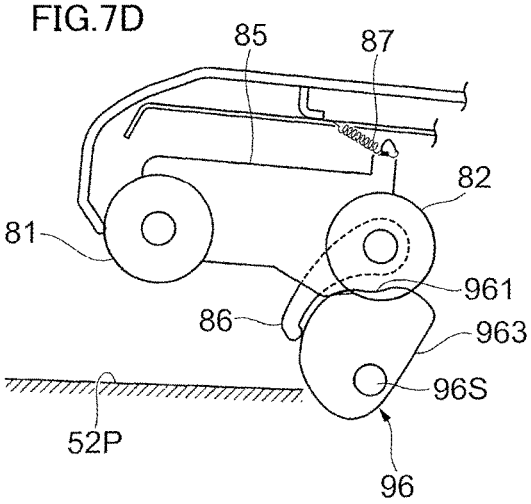

Then, as shown in FIG. 7D, the rotating cam 96 is brought into contact with the arm 86 from the third shape portion 963 to the first shape portion 961, and thereby the supporter 85 moves upward. Then, the supporter 85 returns to the standby position again.

Note that, as described above, as shown in FIGS. 7A and 7B, in the exemplary embodiment, the supporter 85 (the pickup rolls 81) is moved in a direction away from the sheet stacking surface 52P by the driving force of the second motor 97M via the rotating cam 96. On the other hand, as shown in FIG. 7C, the supporter 85 (the pickup rolls 81) is moved in a direction approaching the sheet stacking surface 52P by the spring force of the tension spring 87.

Subsequently, with reference to FIGS. 8 to 11, the relationship between the supporter 85 and the regulation section 80C will be described.

Figure 8:
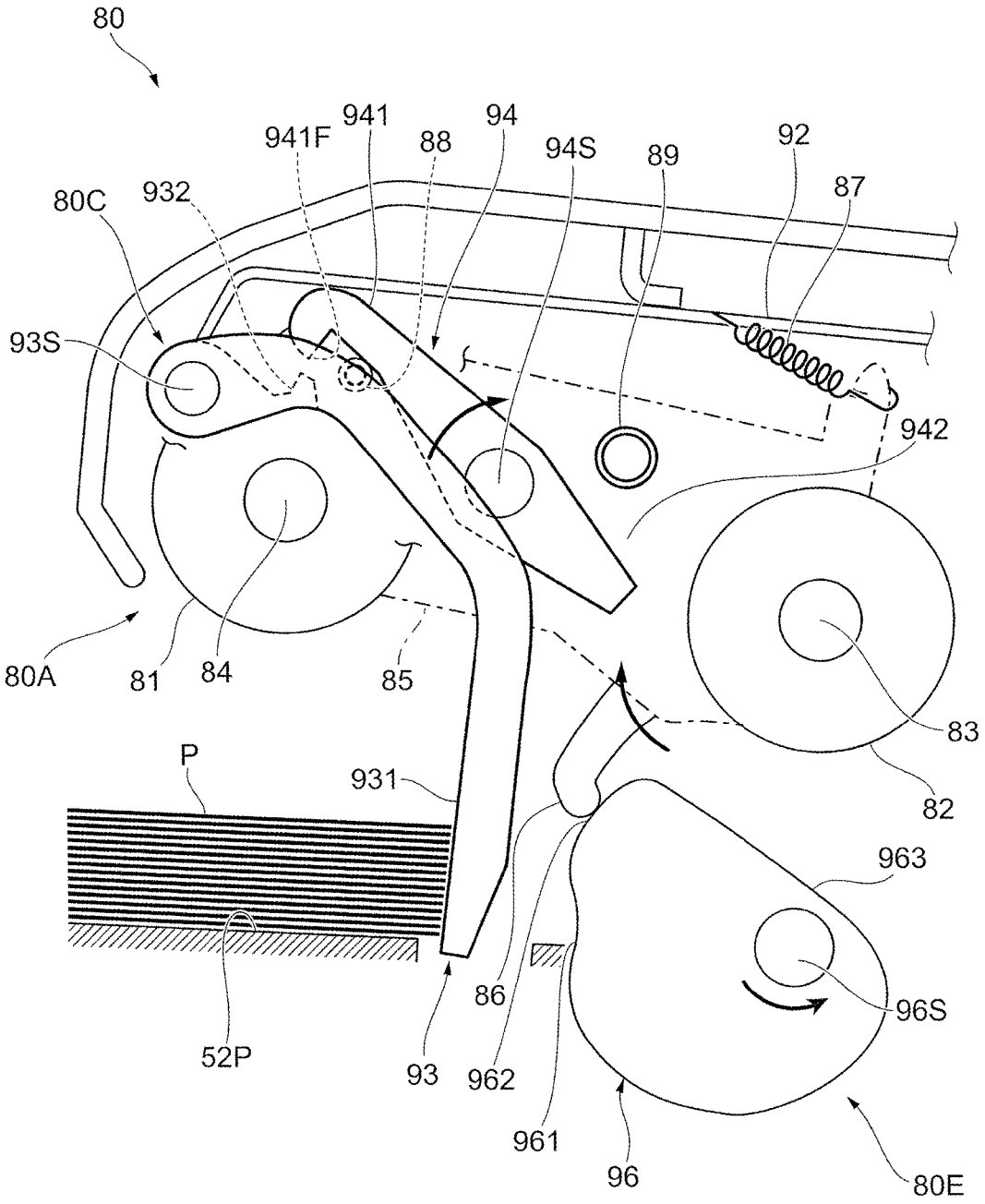
FIG. 8 is a relationship diagram of the supporter and the regulation section at a releasing position.

FIG. 8 is a relationship diagram of the supporter 85 and the regulation section 80C at the releasing position.

Figure 9:
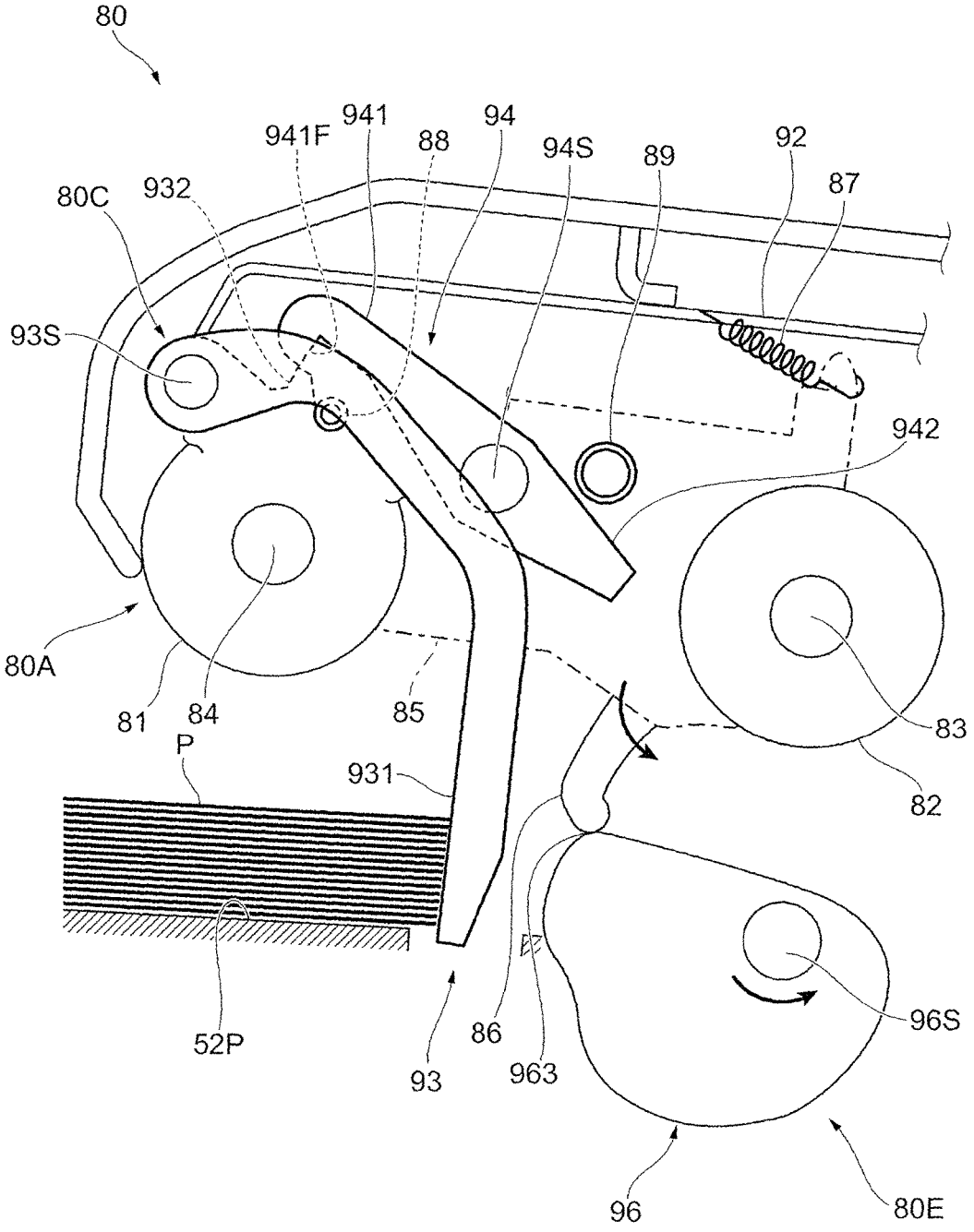
FIG. 9 is a relationship diagram of the supporter and the regulation section moving toward the releasing position.

FIG. 9 is a relationship diagram of the supporter 85 and the regulation section 80C moving toward the releasing position.

Figure 10:
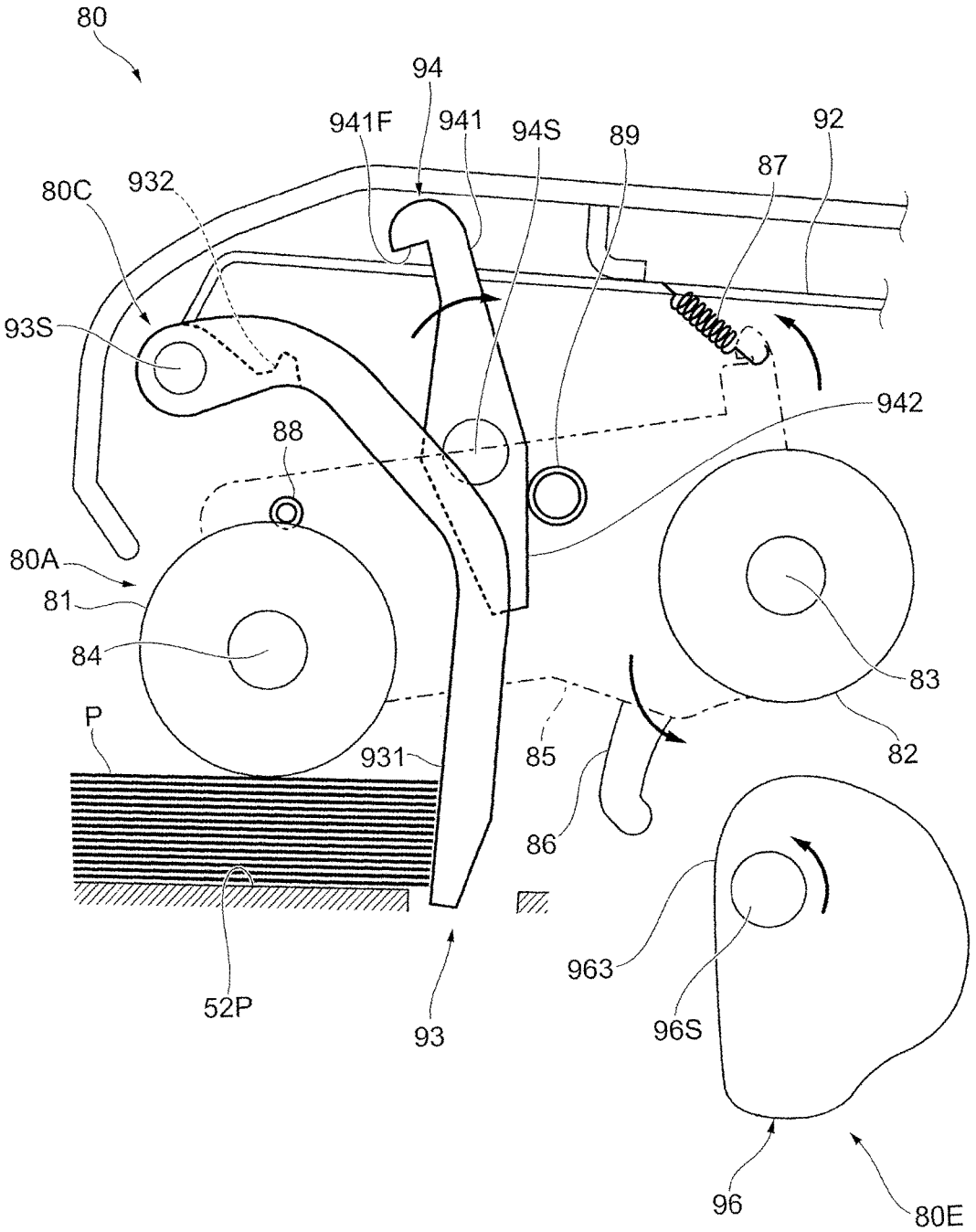
FIG. 10 is a relationship diagram of the supporter and the regulation section at a feeding position.

FIG. 10 is a relationship diagram of the supporter 85 and the regulation section 80C at the feeding position.

Figure 11:
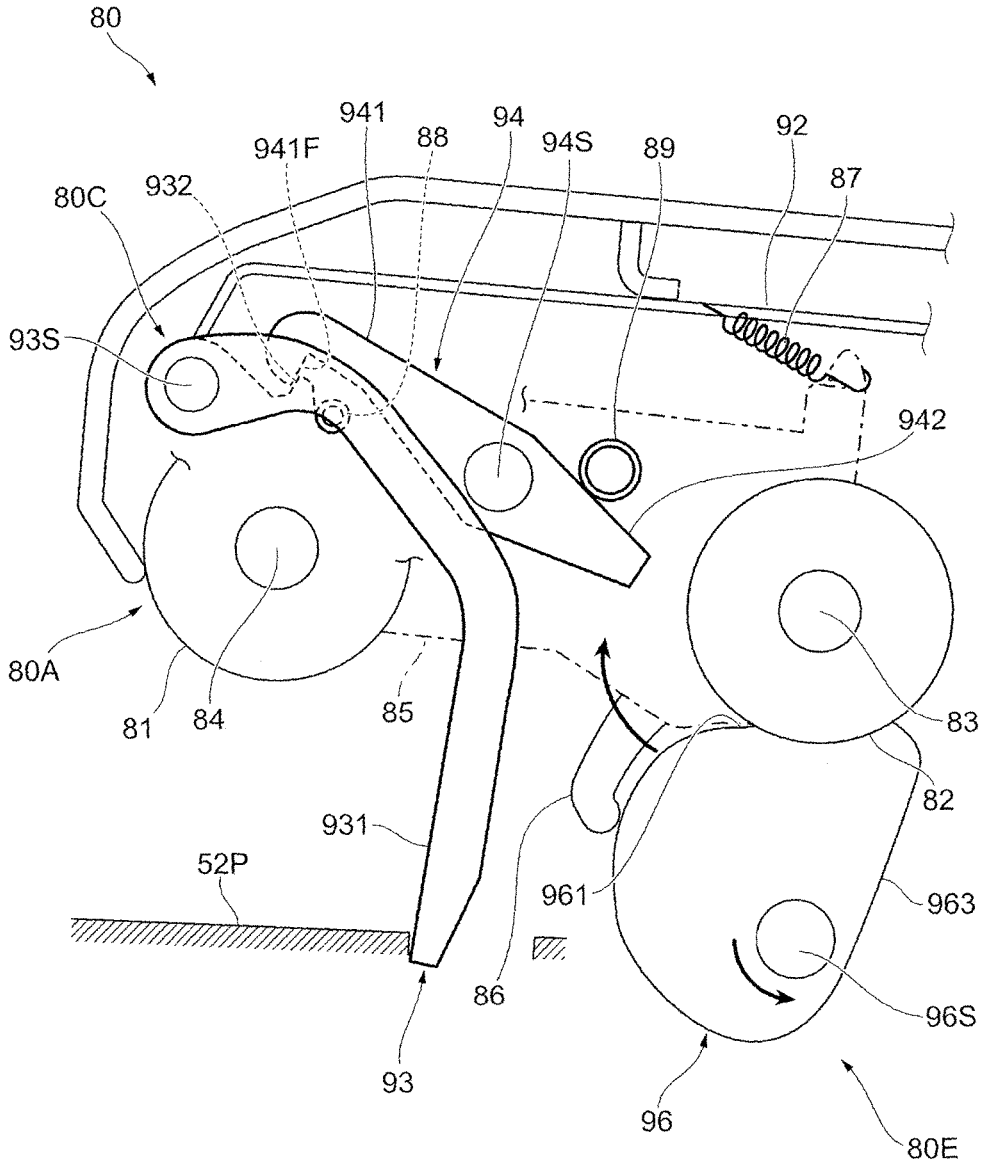
FIG. 11 is a relationship diagram of the supporter and the regulation section moving toward a standby position.

FIG. 11 is a relationship diagram of the supporter 85 and the regulation section 80C moving toward the standby position.

As shown in FIG. 6, the supporter 85 at the standby position sets the pickup rolls 81 at a position separated from the sheet stacking surface 52P by the predetermined distance. Consequently, on the sheet stacking surface 52P, including the location under the pickup rolls 81, the sheets P can be placed. At this time, the stopper 93 is positioned on the downstream side in the sheet feeding direction of the sheet stacking surface 52P. Further, rotation of the stopper 93 is limited by the stopper lock 94. Consequently, even though the sheets P are pressed toward the downstream side in the sheet feeding direction when the user sets the sheets P on the sheet stacking surface 52P, the sheets P do not enter inside the sheet feeding section 80.

Thereafter, for example, with the start of printing or the like by the user as an impetus, the rotating cam 96 is rotated. Then, the sheet feeding section 80, first, moves the supporter 85 moves from the standby position to the releasing position.

As shown in FIG. 8, the supporter 85 at the releasing position sets the pickup rolls 81 at a position farther away than the standby position from the sheet stacking surface 52P. At this time, the unlock section 88 provided to the supporter 85 is moved upward together with the supporter 85. Then, with the movement, the unlock section 88 is brought into contact with the first arm portion 941 of the stopper lock 94. This rotates the stopper lock 94 in a direction in which the latch portion 941F of the stopper lock 94 moves away from the receiving portion 932 of the stopper 93. As a result, the stopper lock 94 releases the limit on the rotation of the stopper 93.

Thereafter, as shown in FIG. 9, the unlock section 88 does not contact the stopper lock 94. Consequently, the stopper lock 94 is going to rotate in a direction in which the latch portion 941F approaches the receiving portion 932. On the other hand, since the load of the sheet bundle is applied to the sheet regulation portion 931, the receiving portion 932 side of the stopper 93 is slightly rotated toward the upstream side in the sheet feeding direction. Accordingly, though not in contact with the unlock section 88, the latch portion 941F of the stopper lock 94 is not engaged in the receiving portion 932.

Further, as shown in FIG. 10, the sheet feeding section 80 further rotates the rotating cam 96, to thereby move the supporter 85 from the releasing position to the feeding position. In other words, the pickup rolls 81 are moved in a direction approaching the sheet stacking surface 52P (the sheets P). At this time, the sheets P are placed on the sheet stacking surface 52P. Therefore, the pickup rolls 81 are stopped at the position to contact the uppermost sheet P of the sheet bundle.

Moreover, since the supporter 85 moves in the direction approaching the sheet stacking surface 52P, the maintaining section 89 fastened to the supporter 85 moves downward together with the supporter 85. Then, with the movement, the maintaining section 89 is brought into contact with the second arm portion 942 of the stopper lock 94. This rotates the stopper lock 94 in a direction in which the latch portion 941F moves away from the receiving portion 932. Consequently, the state of releasing the regulation of the stopper 93 by the stopper lock 94 is maintained. After the limit on the movement of the stopper 93 by the stopper lock 94 is released, the state is continued, at least, for a period in which the supporter 85 moves in the direction approaching the sheet stacking section 52.

Then, in the exemplary embodiment, the sheets P are sequentially fed from the sheet bundle on the sheet stacking surface 52P by the pickup rolls 81.

Thereafter, when all of the sheets P on the sheet stacking surface 52P are fed, the rotating cam 96 is rotated to move the supporter 85 in the direction away from the sheet stacking surface 52P. Note that sensing of presence or absence of the sheets P on the sheet stacking surface 52P is performed by the sensor 98 (refer to FIG. 2).

Then, as shown in FIG. 11, when there is no sheet P on the sheet stacking surface 52P, the sheet regulation portion 931 of the stopper 93 moves toward the upstream side in the sheet feeding direction. In other words, the stopper 93 is going to move in a direction in which the receiving portion 932 approaches the stopper lock 94. Moreover, the supporter 85 moves in the direction away from the sheet stacking surface 52P, to thereby rotate the stopper lock 94 in a direction in which the latch portion 941F approaches the receiving portion 932. This disposes the stopper 93 and the stopper lock 94 in a positional relationship that enables the latch portion 941F and the receiving portion 932 to be engaged in each other again.

In the sheet feeding section 80 of the exemplary embodiment configured as described above, limitation on rotation of the stopper 93 by the stopper lock 94 is released by the unlock section 88 fastened to the supporter 85 driven by the second motor 97M. Accordingly, for example, even in the case where a large load is applied on the stopper 93 and the stopper lock 94 and the stopper 93 are strongly engaged with each other, such as when a large number of sheets P are placed on the sheet stacking surface 52P, the engagement is released by use of the driving force of the second motor 97M.

Moreover, in the sheet feeding section 80 in the exemplary embodiment, the supporter 85 is moved by the spring force of the tension spring 87 to set the supporter 85 at the feeding position. Therefore, in the sheet feeding section 80 of the exemplary embodiment, the pickup rolls 81 contact the sheets P with a constant force regardless of conditions.

[Image Forming Apparatus 1 in Modified Example]

Figure 12A:
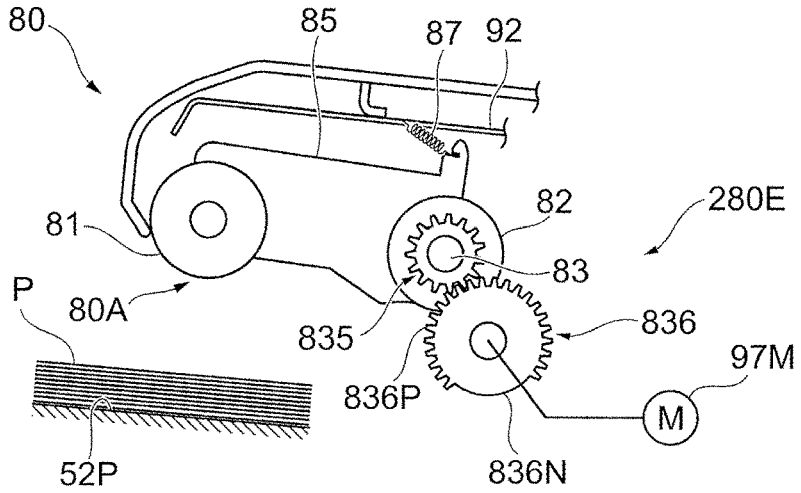
FIGS. 12A to 12C are illustration diagrams of the sheet feeding section in a modified example.
Figure 12B:
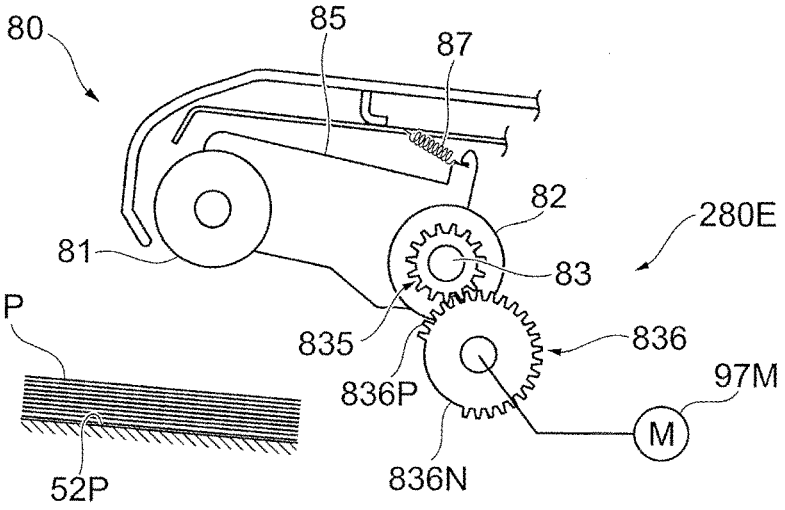
Figure 12C:
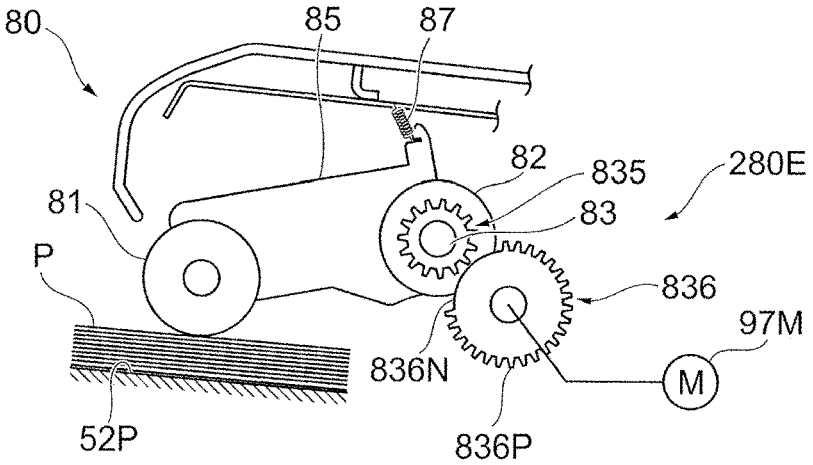

FIGS. 12A to 12C are illustration diagrams of the sheet feeding section 80 in a modified example.

Next, the image forming apparatus 1 of a modified example will be described. Note that, in the description of the modified example, configurations similar to those in the above-described exemplary embodiment are assigned with same reference signs, and detailed descriptions thereof will be omitted.

The image forming apparatus 1 in the modified example is different from the above-described exemplary embodiment in a configuration of a second drive section 280E of the sheet feeding section 80. Hereinafter, the second drive section 280E of the modified example will be described in detail.

As shown in FIG. 12A, the second drive section 280E of the modified example includes: a third gear 835 that transfers power to the supporter 85; a fourth gear 836 connected to the third gear 835; and the second motor 97M that rotates the fourth gear 836.

The third gear 835 is rotatably supported by the first shaft 83. In other words, the third gear 835 spins around the first shaft 83. The third gear 835 is connected to the supporter 85. The third gear 835 is also connected to the fourth gear 836.

The fourth gear 836 is driven by the second motor 97M and transfers the rotational force to the third gear 835. Further, the fourth gear 836 includes: a teeth portion 836P in which teeth engaged with the third gear 835 in the circumferential direction are formed; and a flat portion 836N on which no teeth are formed. In other words, the fourth gear 836 is a missing teeth gear.

In the sheet feeding section 80 of the modified example, the second drive section 280E rotates the fourth gear 836, to thereby moves the supporter 85 to the standby position, the releasing position and the feeding position.

As shown in FIG. 12B, when the supporter 85 is moved from the standby position to the releasing position, the fourth gear 836 is rotated by the second motor 97M. At this time, the teeth portion 836P of the fourth gear 836 is engaged with the third gear 835. This rotates the third gear 835, and thereby the supporter 85 is rotated upwardly around the first shaft 83 as the rotation shaft. With the movement of the supporter 85, the unlock section 88 releases limitation on the rotation of the stopper 93 by the stopper lock 94 (refer to FIG. 8).

Further, as shown in FIG. 12C, when the supporter 85 is moved from the releasing position to the feeding position, the fourth gear 836 is further rotated by the second motor 97M. Therefore, the flat portion 836N of the fourth gear 836 faces the third gear 835. This releases the engagement between the third gear 835 and the fourth gear 836. As a result, the supporter 85 is rotated in a direction in which the pickup rolls 81 approach the sheet stacking surface 52P by the spring force of the tension spring 87.

Thereafter, when the sheets P of the sheet bundle on the sheet stacking surface 52P are sequentially fed, the fourth gear 836 is rotated by the second motor 97M. Then, by engaging the teeth portion 836P of the fourth gear 836 with the third gear 835, the supporter 85 is rotated to return to the standby position again.

Note that, in the description of the exemplary embodiment, the example applying the above-described sheet guiding section 70 in the second sheet supply section 50 is taken; however, the sheet guiding section 70 is not limited to be applied to the second sheet supply section 50. The sheet guiding section 70 may be applied to, for example, the stacking section 21S of the original feeding device 21. Further, the sheet guiding section 70 may be applied to the first sheet supply section 40.

The foregoing description of the present exemplary embodiment of the present invention has been provided for the purposes of illustration and description. It is not intended to be exhaustive or to limit the invention to the precise forms disclosed. Obviously, many modifications and variations will be apparent to practitioners skilled in the art. The present exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

a feeding unit that is provided to be movable in a forward-backward direction to move forward or backward relative to a sheet placing unit on which a sheet is placed, and feeds the sheet;

a moving unit that moves the feeding unit in the forward-backward direction;

a contact unit that is provided to be movable, with which the sheet placed on the sheet placing unit is brought into contact;

a limitation unit that limits movement of the contact unit; and a releasing unit that, when the moving unit moves the feeding unit in a direction away from the sheet placing unit, with the movement of the feeding unit, releases limitation on the movement of the contact unit by the limitation unit.

2. The sheet feeding device according to claim 1, further comprising:

a maintaining unit that, after the limitation on the movement of the contact unit is released by the releasing unit, maintains a state where the limitation on the movement of the contact unit is released for a period in which the moving unit moves the feeding unit in a direction approaching the sheet placing unit.

3. The sheet feeding device according to claim 1, wherein the releasing unit is provided to the feeding unit, and releases the limitation on the movement of the contact unit by the limitation unit by contacting the limitation unit with the movement of the feeding unit in the direction away from the sheet placing unit.

4. The sheet feeding device according to claim 3, wherein the limitation unit comprises a latch portion that is to be engaged in the contact unit, and a rotation shaft, and the releasing unit releases the limitation by contacting between the latch portion and the rotation shaft in the limitation unit.

5. The sheet feeding device according to claim 4, further comprising:

a maintaining unit that, after the limitation on the movement of the contact unit is released by the releasing unit, maintains a releasing state for a period in which the moving unit moves the feeding unit in a direction approaching the sheet placing unit by contacting an opposite side of the latch portion in the limitation unit relative to the rotation shaft.

6. The sheet feeding device according to claim 1, wherein the moving unit causes the feeding unit to approach the sheet placing unit by an elastic force.

7. The sheet feeding device according to claim 1, wherein the moving unit moves the feeding unit by a rotating cam.

8. The sheet feeding device according to claim 7, wherein the rotating cam comprises, in a circumferential direction thereof: a first shape portion that moves the feeding unit away from the sheet placing unit; a second shape portion that causes the feeding unit to approach the sheet placing unit; and a third shape portion that is provided between the first shape portion and the second shape portion to move the feeding unit away from the sheet placing unit farther than the first shape portion.

9. The sheet feeding device according to claim 1, wherein the releasing unit releases the limitation when the feeding unit moves in the direction away from the sheet placing unit beyond a standby position where the feeding unit is on standby before feeding the sheet.

10. The sheet feeding device according to claim 1, wherein the releasing unit releases, in a state in which the sheets of a maximum stacking amount are placed on the sheet placing unit, the limitation when the feeding unit moves in the direction away from the sheet placing unit beyond a position where the feeding unit feeds the sheet.

11. An image forming apparatus comprising:

an image forming unit that forms an image;

a sheet placing unit that places a sheet on which an image is to be formed in the image forming unit;

a feeding unit that is provided to be movable in a forward-backward direction to move forward or backward relative to the sheet placing unit, and feeds the sheet;

a moving unit that moves the feeding unit in the forward-backward direction;

a contact unit that is provided to be movable, with which the sheet placed on the sheet placing unit is brought into contact;

a limitation unit that limits movement of the contact unit; and a releasing unit that, when the moving unit moves the feeding unit in a direction away from the sheet placing unit, with the movement of the feeding unit, releases limitation on the movement of the contact unit by the limitation unit.

12. A sheet feeding device comprising:

feeding means for feeding a sheet, the feeding means being provided to be movable in a forward-backward direction to move forward or backward relative to a sheet placing unit on which the sheet is placed;

moving means for moving the feeding means in the forward-backward direction;

contact means for contacting the sheet placed on the sheet placing unit, the contact means being provided to be movable;

limitation means for limiting movement of the contact means; and, releasing means, when the moving means moves the feeding means in a direction away from the sheet placing unit, for releasing limitation on the movement of the contact means by the limitation means with the movement of the feeding means.

* * * * *